US010766120B2

(12) United States Patent
Hagita et al.

(10) Patent No.: US 10,766,120 B2
(45) Date of Patent: Sep. 8, 2020

(54) METHOD AND DEVICE FOR MANUFACTURING COMPRESSOR SCROLLS, COMPRESSOR SCROLL, AND SCROLL COMPRESSOR

(71) Applicant: MITSUBISHI HEAVY INDUSTRIES THERMAL SYSTEMS, LTD., Minato-ku, Tokyo (JP)

(72) Inventors: Takayuki Hagita, Aichi (JP); Takaharu Maeguchi, Tokyo (JP); Masafumi Hamasaki, Tokyo (JP); Yukio Michishita, Tokyo (JP); Yukihiro Kawai, Tokyo (JP); Hiroshi Ogawa, Tokyo (JP); Makoto Takeuchi, Tokyo (JP); Kazuhide Watanabe, Aichi (JP); Takayuki Kuwahara, Aichi (JP); Masaki Kawasaki, Aichi (JP); Katsuhiro Fujita, Aichi (JP)

(73) Assignee: MITSUBISHI HEAVY INDUSTRIES AUTOMOTIVE THERMAL SYSTEMS CO., LTD., Kiyosu-Shi (JP)

( * ) Notice: Subject to any disclaimer, the term of this patent is extended or adjusted under 35 U.S.C. 154(b) by 595 days.

(21) Appl. No.: 15/519,357

(22) PCT Filed: Aug. 6, 2015

(86) PCT No.: PCT/JP2015/072426
§ 371 (c)(1),
(2) Date: Apr. 14, 2017

(87) PCT Pub. No.: WO2016/059858
PCT Pub. Date: Apr. 21, 2016

(65) Prior Publication Data

US 2017/0239785 A1 Aug. 24, 2017

(30) Foreign Application Priority Data

Oct. 16, 2014 (JP) ..... 2014-211938

(51) Int. Cl.
*B24C 3/32* (2006.01)
*F04C 18/02* (2006.01)
(Continued)

(52) U.S. Cl.
CPC ..... *B24C 3/32* (2013.01); *B24C 1/10* (2013.01); *B24C 11/005* (2013.01); *C21D 7/06* (2013.01);
(Continued)

(58) Field of Classification Search
None
See application file for complete search history.

(56) References Cited

U.S. PATENT DOCUMENTS 4,666,380 A * 5/1987 Hirano ..... F01C 1/0246 29/888.022
5,305,361 A * 4/1994 Enomoto ..... B05B 17/0615 376/316
(Continued)

FOREIGN PATENT DOCUMENTS

EP 2 740 938 A1 6/2014
JP 61-59890 U 4/1986
(Continued)

OTHER PUBLICATIONS

English Translation of JP2013148041, accessed in Aug. 2019. (Year: 2013).*
(Continued)

*Primary Examiner* — Eric W Golightly
*Assistant Examiner* — Arlyn I Rivera-Cordero
(74) *Attorney, Agent, or Firm* — Birch, Stewart, Kolasch & Birch, LLP

(57) ABSTRACT

A method for manufacturing a compressor scroll that appropriately impinges cavitation bubbles on target regions of a scroll. The method includes the step of water jet peening by
(Continued)

jetting cavitation bubbles generated underwater by a water jet at a first side of an end plate (13A) of the scroll (13), with a center (P1, P2, P3) of the cavitation bubbles being offset from a center (O) of the spiral shape of a wall portion (13B) on the end plate (13A) and the step portion (13Aa) and the stepped portion (13Ba) positioned at an outer peripheral portion of the cavitation bubbles (C).

6 Claims, 6 Drawing Sheets

(51) Int. Cl.
*B24C 1/10* (2006.01)
*C21D 7/06* (2006.01)
*B24C 11/00* (2006.01)

(52) U.S. Cl.
CPC ..... *F04C 18/0215* (2013.01); *F04C 18/0269* (2013.01); *F04C 18/0276* (2013.01); *F04C 2230/92* (2013.01)

(56) References Cited

U.S. PATENT DOCUMENTS

| | | | | |
|---|---|---|---|---|
| 6,855,208 | B1 * | 2/2005 | Soyama | B24C 1/10 134/1 |
| 9,050,642 | B2 * | 6/2015 | Alberts | B21D 26/02 |
| 9,732,753 | B2 | 8/2017 | Hirata et al. | |
| 2014/0308146 | A1 | 10/2014 | Hirata et al. | |

FOREIGN PATENT DOCUMENTS

| | | | | |
|---|---|---|---|---|
| JP | 2-61381 | A | 3/1990 | |
| JP | 3-126850 | A | 5/1991 | |
| JP | 3162104 | B2 | 4/2001 | |
| JP | 2005-61294 | A | 3/2005 | |
| JP | 2005-125458 | A | 5/2005 | |
| JP | 2009-74540 | A | 4/2009 | |
| JP | 2012-31768 | A | 2/2012 | |
| JP | 2013-36366 | A | 2/2013 | |
| JP | 2013-144940 | A | 7/2013 | |
| JP | 2013148041 | * | 8/2013 | F04C 18/0215 |
| JP | 2014-9593 | A | 1/2014 | |

OTHER PUBLICATIONS

English translation of the Written Opinion of the International Searching Authority (Form PCT/ISA/237), dated Nov. 2, 2015, for International Application No. PCT/JP2015/072426.

International Search Report for PCT/JP2015/072426 (PCT/ISA/210) dated Nov. 2, 2015.

Written Opinion of the International Searching Authority for PCT/JP2015/072426 (PCT/ISA/237) dated Nov. 2, 2015.

Japanese Office Action, dated Jan. 28, 2020, for Japanese Application No. 2019-042027, along with an English translation, 5 pages.

* cited by examiner

METHOD AND DEVICE FOR MANUFACTURING COMPRESSOR SCROLLS, COMPRESSOR SCROLL, AND SCROLL COMPRESSOR

TECHNICAL FIELD

The present invention relates to a method and device for manufacturing a scroll for a compressor, a compressor scroll, and a scroll compressor.

BACKGROUND ART

Conventional scroll compressors include a fixed scroll with a spiral-shaped wall portion provided on a first side of an end plate and an orbiting scroll with a wall portion on a first side of an end plate with essentially the same spiral shape as that of the wall portion of the fixed scroll. The first sides of the end plates of the fixed scroll and the orbiting scroll are brought to face one another to assembly the wall portions together. In this mated state, the orbiting scroll orbits about the fixed scroll to gradually reduce the volume of the compression chamber formed between the wall portions and compress the fluid in the compression chamber.

An example of a conventional scroll for a compressor is described in the method of manufacturing a scroll compressor of Patent Document 1. In Patent Document 1, a fixed scroll and/or an orbiting scroll is rendered with a plurality of minute recesses on the side (wrap side) opposite the end plate (end cover) by being jetted with a fluid containing abrasive particles. This is to help with the retention of lubricating oil on the surface.

Additionally, for example, in the method of enhancing residual stress of a metallic material described in Patent Document 2, to prevent stress corrosion cracking at a weld portion of the metallic material and nearby, a fluid flow containing cavitation bubbles is impinged on the surface of the metallic material, the cavitation bubbles being generated by cavitation via water jet. The impact force generated by the collapse of the cavitation bubbles imparts compressive residual stress to the metallic material.

CITATION LIST

Patent Documents

Patent Document 1: Japanese Unexamined Patent Application Publication No. 2009-074540A Patent Document 2: Japanese Patent No. 3162104B

SUMMARY OF INVENTION

Technical Problem

Scrolls for compressors experience a concentration of stress at the corner portion where the end plate and the wall portion are joined when in operation. Such fatigue is likely to cause cracks. Accordingly, it is desirable to enhance the fatigue strength by imparting compressive residual stress to the target region particularly vulnerable to fatigue-generated cracks. Methods of imparting such residual stress include peening. However, in typical shot peening methods, the steels balls used for peening may not hit the target region. Thus, such methods are not suitable for application to scrolls. A method in which cavitation bubbles generated by a water jet are used is more suitable for application to scrolls than shot peening methods because these cavitation bubbles tend to reach smaller regions such as the target region described above.

However, while the application of cavitation bubbles generated by a water jet can be considered suitable, scrolls have a shape different from the plate-like shape of the workpiece in Patent Document 2 in that a wall portion is provided on an end plate. Such a shape can make it difficult for the cavitation bubbles to impinge on the target region to impart compressive residual stress thereto.

To solve the problems described above, the present invention provides a method and device for manufacturing a compressor scroll capable of appropriately impinging cavitation bubbles on a target region of the scroll, and a compressor scroll and a scroll compressor resistant to cracks.

Solution to Problem

To achieve the object described above, an embodiment of the present invention is a method for manufacturing a compressor scroll, the compressor scroll including a first scroll provided on a spiral-shaped first wall portion disposed on a first side of a first end plate, a second scroll provided on a spiral-shaped second wall portion disposed on a first side of a second end plate, with the second wall portion meshed with the first wall portion of the first scroll, wherein the second scroll is supported for orbiting movement and prevented from rotating, a step portion disposed on the first side of each of the end plates where a height transitions from high on a center portion side of the spiral following the respective wall portion to low on an outer end side, and a stepped portion disposed on each of the wall portions where a height transitions from low on the central portion side of the spiral to high on the outer end side, wherein the stepped portions engage with the corresponding step portions, the method comprising the step of water jet peening by jetting cavitation bubbles generated underwater by a water jet at the first side of the end plate of at least one of the scrolls, with a center of the cavitation bubbles being offset from a center of the spiral shape of the wall portion on the end plate and the step portion and the stepped portion positioned at an outer peripheral portion of the cavitation bubbles.

According to this method for manufacturing a compressor scroll, the center of the cavitation bubbles is offset from the center of the spiral shape of the wall portion on the end plate. When the step portion and the stepped portion are positioned at the outer peripheral portion of the range of the cavitation bubbles, the position of the center of the cavitation bubbles becomes positions where corner portions of the wall portion near the step portion and the stepped portion are positioned on a straight line through the spiral-shaped channel of the wall portion. This allows the flow of fluid flow containing the cavitation bubbles to not be obstructed by the wall portion, and thus allow the cavitation bubbles to impinge on the corner portions. In other words, the cavitation bubbles can be appropriately impinged on target regions of the scroll, imparting compressive residual stress to the target regions to prevent cracks.

In a method for manufacturing a compressor scroll according to another embodiment of the present invention, the water jet peening step includes moving the cavitation bubbles and the scroll relative to one another to intersect with a straight imaginary line that joins the step portion and the stepped portion and the positions of the cavitation bubbles and the scroll.

According to this method for manufacturing a compressor scroll, the cavitation bubbles can be appropriately impinged on the target regions (the corner portions) of the scroll, imparting compressive residual stress to the target regions to prevent cracks.

In a method for manufacturing a compressor scroll according to another embodiment of the present invention, the water jet peening step includes stopping the movement of the cavitation bubbles and the scroll relative to one another for a predetermined period of time at the positions of the cavitation bubbles and the scroll.

According to this method for manufacturing a compressor scroll, the cavitation bubbles can be sufficiently impinged on the target regions (the corner portions) of the scroll, imparting compressive residual stress to the target regions to prevent cracks.

In a method for manufacturing a compressor scroll according to another embodiment of the present invention, the water jet peening step is performed before surface treatment of the scroll.

According to this method for manufacturing a compressor scroll, the water jet peening step is performed before the surface treatment of the scroll. This facilitates imparting compressive residual stress via impingement of the cavitation bubbles to obtain a significant effect of preventing cracks.

In a method for manufacturing a compressor scroll according to another embodiment of the present invention, a cleaning fluid is mixed in with the water where the cavitation bubbles are generated.

According to this method for manufacturing a compressor scroll, the scroll can be cleaned by the cleaning fluid at the same time as the water jet peening step.

To achieve the object described above, an embodiment of the present invention is a device for manufacturing a compressor scroll, the compressor scroll including a first scroll provided on a spiral-shaped first wall portion disposed on a first side of a first end plate, a second scroll provided on a spiral-shaped second wall portion disposed on a first side of a second end plate with the second wall portion meshed with the first wall portion of the first scroll, wherein the second scroll is supported for orbiting movement and prevented from rotating, a step portion disposed on the first side of each of the end plates where, following the respective wall portion, a height transitions from high on a center portion side of the spiral to low on an outer end side, and a stepped portion disposed on each of the wall portions where a height transitions from low on the central portion side of the spiral to high on the outer end side, wherein the stepped portions engage with the corresponding step portions, the device comprising a vessel containing water; a positioning unit that positions at least one of the scrolls in the vessel; a water jet jetting disposed underwater in the vessel that includes a nozzle that jets a water jet at the scroll; wherein cavitation bubbles generated underwater in the vessel by the water jet of the water jet jetting unit are jet at the first side of the scroll, with a center of the cavitation bubbles being offset from a center of the spiral shape of the wall portion on the end plate and the step portion and the stepped portion positioned at an outer peripheral portion of the cavitation bubbles.

According to this device for manufacturing a compressor scroll, the water jet peening step described above in the method for manufacturing a compressor scroll can be performed.

In a device for manufacturing a compressor scroll according to another embodiment of the present invention, the positioning unit includes a fixing mechanism that engages with the end plate of the scroll to fix the scroll.

According to this device for manufacturing a compressor scroll, by fixing the scroll via this fixing mechanism, the scroll can be supported in place when the cavitation bubbles impinge on the scroll, allowing the cavitation bubbles to be appropriately impinged on the target regions (the corner portions) to impart compressive residual stress to the target regions and prevent cracks.

In a device for manufacturing a compressor scroll according to another embodiment of the present invention, the positioning unit includes a movement mechanism that moves the scroll to intersect with a straight imaginary line that joins the step portion and the stepped portion and the positions of the cavitation bubbles and the scroll.

According to this device for manufacturing a compressor scroll, the cavitation bubbles can be appropriately impinged on the target regions (the corner portions) of the scroll, imparting compressive residual stress to the target regions to prevent cracks.

In a device for manufacturing a compressor scroll according to another embodiment of the present invention, the movement mechanism includes a plurality of fixing mechanisms to move a plurality of the scrolls.

According to this device for manufacturing a compressor scroll, the cavitation bubbles can be appropriately impinged in order to target regions (the corner portions) of a plurality of scrolls. As a result, the water jet peening step of the method for manufacturing a compressor scroll described above can be efficiently performed.

In a device for manufacturing a compressor scroll according to another embodiment of the present invention, the water jet jetting unit includes a pivot mechanism that pivots the nozzle so that the cavitation bubbles are pivoted with respect to the scroll.

According to this device for manufacturing a compressor scroll, the cavitation bubbles can directly impinge on the target regions (the corner portions), which are internal angle portion of the end plate and the wall portion. Thus, the cavitation bubbles can be sufficiently impinged on the target regions of the scroll.

To achieve the object described above, an embodiment of the present invention is a compressor scroll made using the device for manufacturing a compressor scroll described above.

According to this compressor scroll, cracks can be prevented, and accidents caused by cracks can be reduced.

To achieve the object described above, an embodiment of the present invention is a scroll compressor, comprising the compressor scroll described above.

According to this scroll compressor, cracks can be prevented, and accidents caused by cracks can be reduced.

Advantageous Effects of Invention

According to the present invention, cavitation bubbles can be appropriately impinged on target regions of a scroll.

DESCRIPTION OF EMBODIMENTS

Embodiments according to the present invention will be described below on the basis of the drawings. Note that the present invention is not limited by these embodiments. In addition, the constituent elements in the embodiments described below include those that can be easily replaced by a person skilled in the art or those that are substantially the same.

Figure 1:
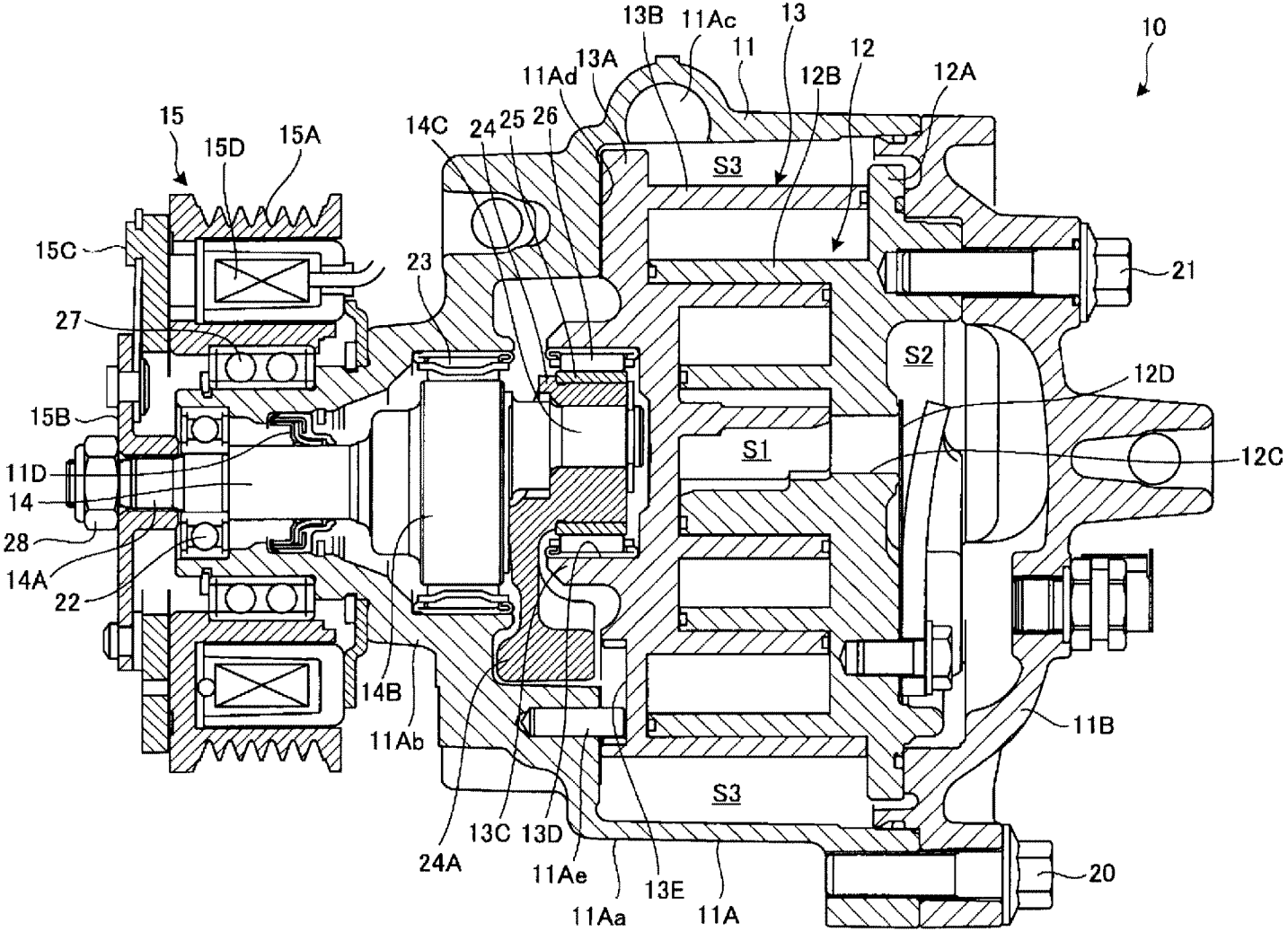
FIG. 1 is a cross-sectional view illustrating an example of a scroll compressor according to an embodiment of the present invention.
Figure 2:
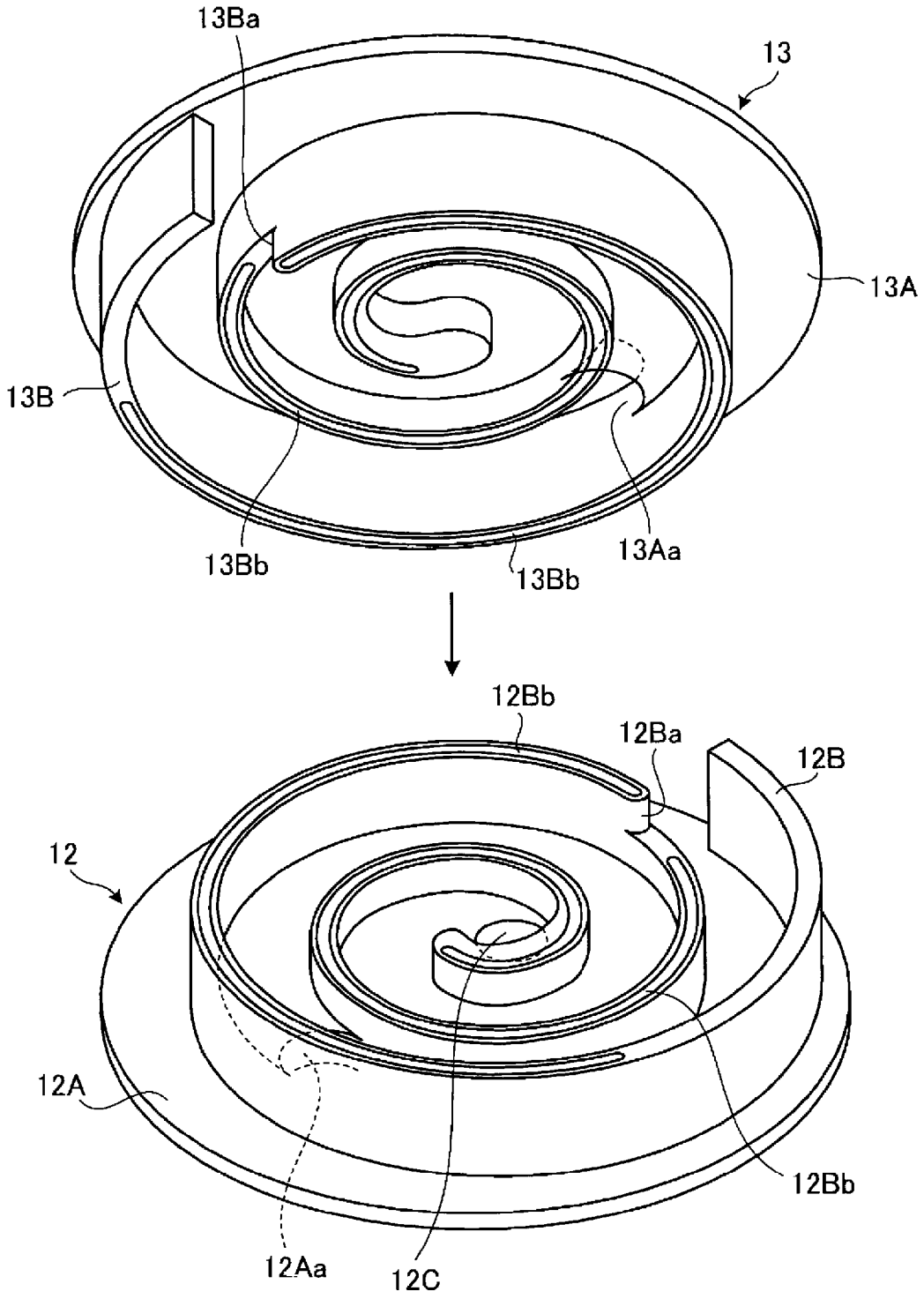
FIG. 2 is a perspective view illustrating a fixed scroll and an orbiting scroll according to an embodiment of the present invention.
Figure 3:
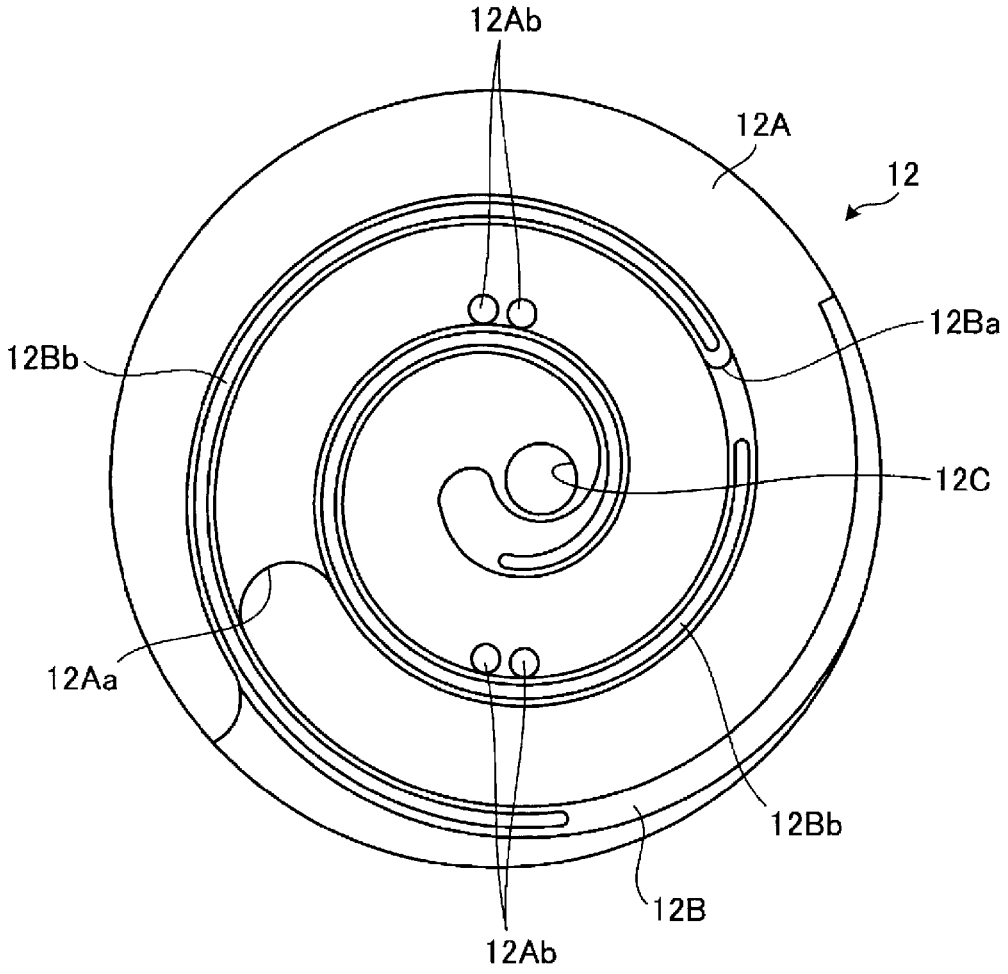
FIG. 3 is a front view illustrating a fixed scroll according to an embodiment of the present invention.
Figure 4:
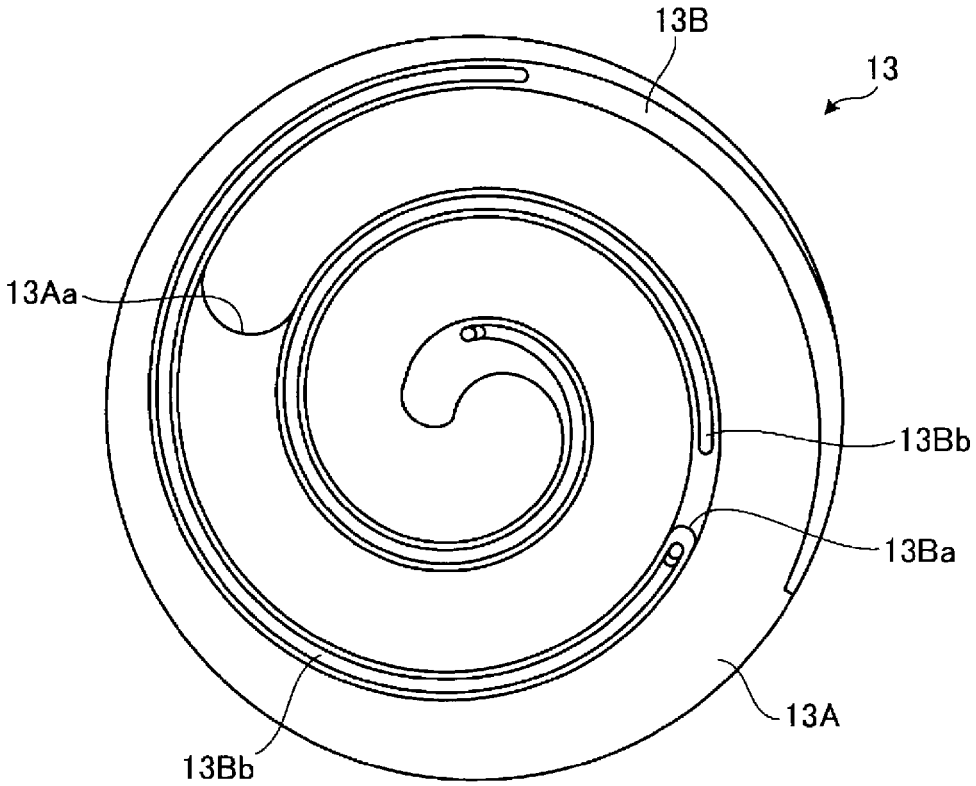
FIG. 4 is a front view illustrating an orbiting scroll according to an embodiment of the present invention.

FIG. 1 is a cross-sectional view illustrating an example of a scroll compressor according to the present embodiment. FIG. 2 is a perspective view of a fixed scroll and an orbiting scroll according to the present embodiment. FIG. 3 is a front view of the fixed scroll according to the present embodiment. FIG. 4 is a front view of the orbiting scroll according to the present embodiment.

A scroll compressor 10 illustrated in FIG. 1 is used mainly to compress a refrigerant of a vehicular air conditioning device. The scroll compressor 10 is provided with a scroll compression mechanism including a fixed scroll 12, or first scroll, and an orbiting scroll 13, or second scroll, inside a housing 11.

The housing 11 composes a housing main body 11A and a cover 11B. The housing main body 11A is hollow and includes an integrated tubular large diameter portion 11Aa and small diameter portion 11Ab. An opening end of the housing main body 11A on the side where the large diameter portion 11Aa is located is mated and closed with the cover 11B fixed via a plurality of bolts 20. A drive shaft 14 is inserted in the housing main body 11A on the side where the small diameter portion 11Ab is located and a shaft seal 11D seals the space between the drive shaft 14 and the housing main body 11A. In such a manner, the housing 11 is configured as a sealed container that encloses the entire scroll compressor.

The fixed scroll 12, as illustrated in FIG. 2, includes a disk-shaped end plate (disk) 12A, and a spiral-shaped wall portion (wrap) 12B provided on a first side of the end plate 12A.

The fixed scroll 12, as illustrated in FIGS. 2 and 3, also includes a step portion 12Aa on the first side of the end plate 12A where the wall portion 12B is provided. Following the spiral direction of the wall portion 12B, the level of the end plate 12A transitions from high on the center portion side of the step portion 12Aa to low on the outer end side. Additionally, the fixed scroll 12 includes a stepped portion 12Ba where the level of the wall portion 12B transitions from low on the center portion side to high on the outer end side. Furthermore, the fixed scroll 12 includes a groove formed on the tip of the wall portion 12B in which a tip seal 12Bb is provided. Note that in the present embodiment, the fixed scroll 12, as illustrated in FIG. 3, also includes a bypass hole 12Ab on the end plate 12A for preventing excessive compression in a compression chamber S1 described below.

The orbiting scroll 13 is similar to the fixed scroll 12 and, as illustrated in FIG. 2, includes a disk-shaped end plate (disk) 13A, and a spiral-shaped wall portion (wrap) 13B provided on a first side of the end plate 13A.

The orbiting scroll 13 is also similar to the fixed scroll 12 in that, as illustrated in FIGS. 2 and 4, it also includes a step portion 13Aa on the first side of the end plate 13A where the wall portion 13B is provided. Following the spiral direction of the wall portion 13B, the level of the end plate 13A transitions from high on the center portion side of the step portion 13Aa to low on the outer end side. Additionally, the orbiting scroll 13 includes a stepped portion 13Ba where the level of the wall portion 13B transitions from low on the center portion side to high on the outer end side. Furthermore, the orbiting scroll 13 includes a groove formed on the tip of the wall portion 13B in which a tip seal 13Bb is provided.

The fixed scroll 12 and the orbiting scroll 13, as illustrated in FIG. 1, are disposed inside the large diameter portion 11Aa of the housing main body 11A. The respective first sides of the end plates 12A, 13A are brought together in opposition and the wall portion 12B, 13B are engaged offset by a phase of 180° with the tips in contact with the first sides of the end plates 12A, 13A, thus forming the compression chamber S1 in the space defined by the end plates 12A, 13A and the wall portions 12B, 13B. Here, when the fixed scroll 12 and the orbiting scroll 13 are assembled together, the step portions 12Aa, 13Aa and the stepped portions 12Ba, 13Ba are engaged. Additionally, as illustrated in FIG. 1, a suction chamber S3 that communicates with the compression chamber S1 is formed inside the housing main body 11A at the periphery of the wall portions 12B, 13B of the fixed scroll 12 and the orbiting scroll 13. The housing main body 11A includes a suction port 11Ac for the suction of a refrigerant gas which opens to the suction chamber S3.

As illustrated in FIG. 1, an outer peripheral portion on a second side of the end plate 12A of the fixed scroll 12 fits closely and mates with an inner peripheral surface of the cover 11B. The cover 11B is fixed to the fixed scroll 12 at a plurality of positions via a plurality of bolts 21. In such a manner, a discharge chamber S2 is defined on the other side of the end plate 12A of the fixed scroll 12 with the cover 11B of the housing 11. The fixed scroll 12 is provided with a discharge port 12C at a central position of the spiral shape of the wall portion 12B on the end plate 12A. The discharge port 12C passes through the fixed scroll 12 connecting the compression chamber S1 and the discharge chamber S2. Additionally, the fixed scroll 12 is provided with a discharge valve 12D on the end plate 12A. The discharge valve 12D includes a flat spring to open the discharge port 12C when the pressure reaches a predetermined amount.

Additionally, a second side of the end plate 13A of the orbiting scroll 13 is in contact with a wall 11Ad, which is where the large diameter portion 11Aa and the small diameter portion 11Ab inside the housing main body 11A meet. This restricts movement of the orbiting scroll 13 in the axial direction, which is the extending direction of the drive shaft 14.

The drive shaft 14, as described above, is inserted in the small diameter portion 11Ab of the housing main body 11A. The drive shaft 14 is able to freely rotate with a first end portion 14A of the drive shaft 14 being supported inside the small diameter portion 11Ab by a bearing 22, a large diameter disk portion 14B disposed in a central portion being supported by a bearing 23, as illustrated in FIG. 1. At a second end portion of the drive shaft 14, an eccentric shaft 14C disposed eccentric to the rotation center of the drive shaft 14 is provided integrally with the disk portion 14B. Rotation of the drive shaft 14 moves the eccentric shaft 14C in an orbiting manner.

The eccentric shaft 14C mates with a balance bushing 24 disposed on the outer periphery thereof. The balance bushing 24 moves in an orbiting manner integrally with the eccentric shaft 14C. The balance bushing 24 is integrally provided with a balance weight 24A to offset the amount of unbalance caused by the orbiting scroll 13. The portion that mates with the eccentric shaft 14C of the balance bushing 24 is cylindrical, and an annular drive bushing 25 is mounted on the outer peripheral portion thereof.

The orbiting scroll 13 is provided with a protruding boss 13C in the central portion on the other side of the end plate 13A. The boss 13C is provided with a circular recessed portion 13D with a center corresponding to the position of the center of the spiral shape of the wall portion 12B. The drive bushing 25 is inserted in the recessed portion 13D of the orbiting scroll 13, the two being able to rotate relative to one another via a bearing 26. The orbiting scroll 13 is provided with a circular rotation-restricting recessed portion 13E on the outer peripheral portion on the other side of the end plate 13A. A plurality of the rotation-restricting recessed portions 13E are provided about the recessed portion 13D. A rotation stopping pin 11Ae that is fixed to the housing main body 11A is inserted in each of the rotation-restricting recessed portions 13E. By inserting the rotation stopping pins 11Ae in the rotation-restricting recessed portion 13E, the rotation of the orbiting scroll 13 is prevented.

The drive shaft 14 is driven in rotation by a drive unit 15. The drive unit 15 includes a pulley 15A supported for free rotation by a bearing 27 mounted on the outer peripheral portion of the small diameter portion 11Ab of the housing main body 11A. The drive unit 15 includes a rotation plate 15B fixed to the first end portion 14A of the drive shaft 14 by a nut 28. The rotation plate 15B is coupled to a support ring 15C on the outer peripheral portion thereof. An end surface of the pulley 15A is fixed to the support ring 15C. An electromagnetic clutch 15D is provided inside the pulley 15A. The pulley 15A transmits torque from the driving source (engine, for example) via a drive belt (not illustrated).

In the scroll compressor 10 configured as such, when the electromagnetic clutch 15D is disengaged, the driving source torque is transmitted to the pulley 15A of the drive unit 15 and the drive shaft 14 rotates. The rotation of the drive shaft 14 rotates the eccentric shaft 14C in an eccentric manner. The rotation of the eccentric shaft 14C is transmitted to the orbiting scroll 13 via the balance bushing 24 and the drive bushing 25. The orbiting scroll 13 orbits with its rotation prevented via the engagement of the rotation-restricting recessed portion 13E and the rotation stopping pin 11Ae. The refrigerant gas taken in to the suction chamber S3 inside the housing 11 from the suction port 11Ac is taken into the compression chamber S1 by this movement. Then, as the orbiting scroll 13 continues to orbit, the compression chamber S1 becomes gradually narrower towards the center of the scrolls 12, 13 and the volume decreases. Inside the compression chamber S1, the refrigerant gas is compressed and it flows toward the central portion of the scrolls 12, 13 until reaching the discharge port 12C. The discharge valve 12D opens or closes depending on the difference in pressure between the compression chamber S1 and the discharge chamber S2. In other words, the refrigerant gas is compressed in the compression chamber S1 and when the compression chamber S1 has a higher pressure than the discharge chamber S2, the refrigerant gas pushes open the discharge valve 12D and flows into the discharge chamber S2. Thereafter, the high pressure refrigerant gas is discharged from the discharge chamber S2 through a discharge port (not illustrated) provided on the cover 11B and outside of the housing 11 and introduced into an air conditioner mounted in a vehicle.

Figure 5:
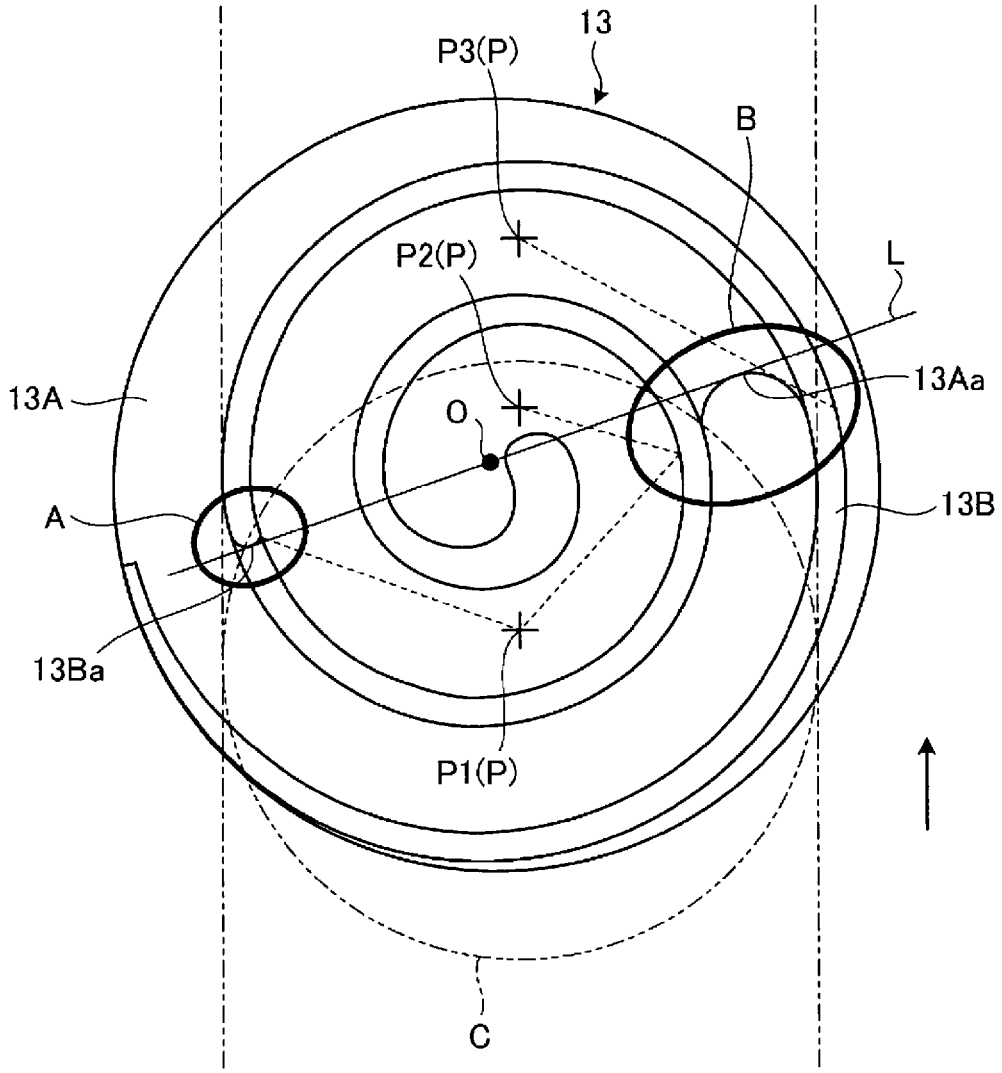
FIG. 5 is a schematic view illustrating a method for manufacturing a compressor scroll according to an embodiment of the present embodiment.
Figure 6:
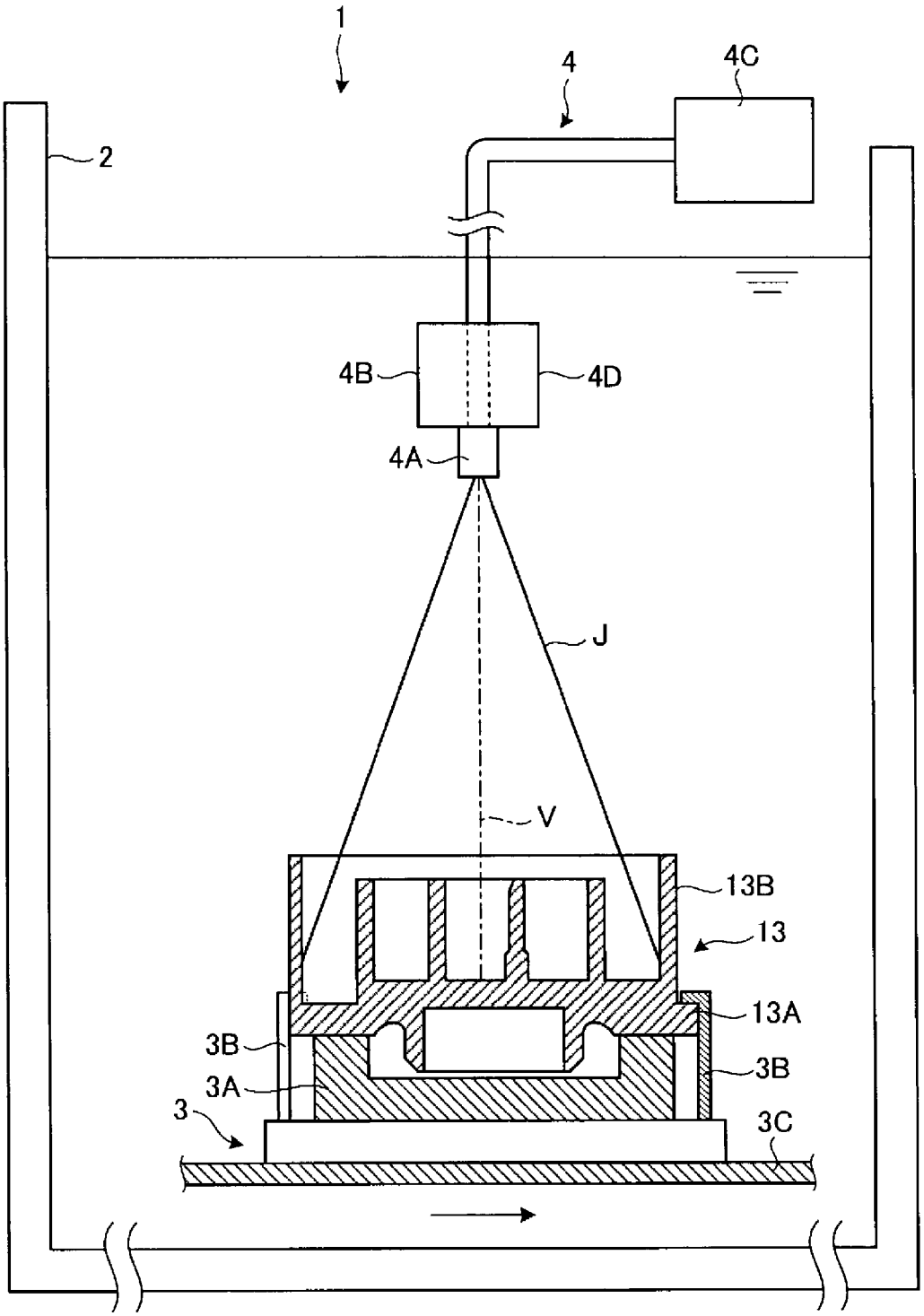
FIG. 6 is a schematic side view illustrating a device for manufacturing a compressor scroll according to an embodiment of the present embodiment.

A method and device for manufacturing a compressor scroll according to the present embodiment will be described below. FIG. 5 is a schematic view illustrating a method for manufacturing a compressor scroll according to the present embodiment. FIG. 6 is a schematic side view illustrating a device for manufacturing a compressor scroll according to the present embodiment. Note that in the description below, "compressor scroll" includes the fixed scroll 12 and the orbiting scroll 13 described above and is simply referred to as "scroll" below. Additionally, for the sake of convenience, the scroll illustrated in FIGS. 5 and 6 is the orbiting scroll 13.

In a method and device for manufacturing the compressor scroll according to the present embodiment, to enhance crack resistance at a corner portion of the end plate 13A and the wall portion 13B of the scroll 13, a fluid flow containing cavitation bubbles generated underwater via cavitation by a water jet is impinged on the corner portion. The impact force generated by the collapse of the cavitation bubbles imparts compressive residual stress to the metallic material.

Here, target regions for compressive residual stress, which are crack-prone regions, are corner portion A and corner portion B as illustrated in FIG. 5. Corner portion A is the base of the spiral wall portion 13B located near the stepped portion 13Ba. Corner portion B is the base of the spiral wall portion 13B located near the step portion 13Aa. The corner portions A, B have a shape conducive to stress concentration. Additionally, in particular, stress is likely to concentrate at the corner portion B as it is where corner portions meet. Thus, it is desirable for cavitation bubbles to be impinged on the corner portions A, B.

Here, in the method for manufacturing a compressor scroll according to the present embodiment, as illustrated in FIG. 5, water jet peening is performed. Cavitation bubbles C are jetted toward the first side of the end plate 13A of the scroll 13, and the center P of the cavitation bubbles C is offset from the center Oof the spiral shape of the wall portion 13B on the end plate 13A so that the step portion 13Aa and the stepped portion 13Ba are positioned at the outer peripheral portion of the range of the cavitation bubbles C (the circular range indicated by the long dashed double-short dashed line in FIG. 5). The center P of the cavitation bubbles C, as illustrated in FIG. 5, may be located at position P1 where the corner portions A, B are positioned on a straight line through the spiral-shaped channel of the wall portion 13B, position P2 where the corner portion B is positioned on a straight line through the spiral-shaped channel of the wall portion 13B, and position P3 where the corner portion B is positioned on a straight line through the spiral-shaped channel of the wall portion 13B.

For example, if the center P of the cavitation bubbles C is located at the center O of the spiral shape of the wall portion 13B on the end plate 13A, because the corner portions A, B are not positioned on a straight line through the spiral-shaped channel of the wall portion 13B, the flow of the fluid flow containing the cavitation bubbles C is inhibited and interrupted by the wall portion 13B, thus making it difficult for the cavitation bubbles C to impinge on the corner portions A, B.

Alternatively, according to a method for manufacturing a compressor scroll according to the present embodiment, as described above, the center P of the cavitation bubbles C is offset from the center O of the spiral shape of the wall portion 13B on the end plate 13A. When the step portion 13Aa and the stepped portion 13Ba are positioned at the outer peripheral portion of the range of the cavitation bubbles C, the position of the center P of the cavitation bubbles C becomes positions P1, P2, or P3 where the corner portions A, B of the wall portion 13B near the step portion 13Aa and the stepped portion 13Ba are positioned on a straight line through the spiral-shaped channel of the wall portion 13B. This allows the flow of fluid flow containing the cavitation bubbles C to not be obstructed by the wall portion 13B, and thus allow the cavitation bubbles C to impinge on the corner portions A, B. In other words, the cavitation bubbles C can be appropriately impinged on target regions of the scroll 13, imparting compressive residual stress to the target regions to prevent cracks.

Additionally, a method for manufacturing a compressor scroll according to the present embodiment, as illustrated in FIG. 5, may include a water jet peening step. In this step, the cavitation bubbles C and the scroll 13 are moved relative to one another to intersect with a straight imaginary line L that joins the step portion 13Aa and the stepped portion 13Ba and the positions P1, P2, P3 of the cavitation bubbles C and the scroll 13. Movement can be performed by moving the cavitation bubbles C, the scroll 13, or the cavitation bubbles C and the scroll 13.

According to this method for manufacturing a compressor scroll, the cavitation bubbles C can be appropriately impinged on the target regions (the corner portions A, B) of the scroll 13, imparting compressive residual stress to the target regions to prevent cracks.

Additionally, a water jet peening step of a method for manufacturing a compressor scroll according to the present embodiment may include stopping the movement of the cavitation bubbles C and/or the scroll 13 for a predetermined period of time at the positions P1, P2, P3 of the cavitation bubbles C and the scroll 13.

According to this method for manufacturing a compressor scroll, the cavitation bubbles C can be sufficiently impinged on the target regions (the corner portions A, B) of the scroll 13, imparting compressive residual stress to the target regions to prevent cracks. Note that "predetermined period of time" refers to a period of time necessary for a target regions to be imparted with compressive residual stress.

Additionally, in a method for manufacturing a compressor scroll according to the present embodiment, a water jet peening step is performed before the surface treatment of the scroll 13.

Surface treatment may be alumite treatment in which the surface is coated with alumite to enhance the corrosion resistance and abrasion resistance in case where the scroll 13 is made of an aluminum alloy. By performing surface treatment, the compressive residual stress imparted via impingement of the cavitation bubbles C may be suppressed and thus the effect of preventing cracks may be reduced. Thus, according to this method for manufacturing a compressor scroll, the water jet peening step is performed before the surface treatment of the scroll 13. This facilitates imparting compressive residual stress via impingement of the cavitation bubbles C to obtain a significant effect of preventing cracks.

Additionally, in a method for manufacturing a compressor scroll according to the present embodiment, a cleaning fluid is mixed in with the water where the cavitation bubbles C are generated.

According to this method for manufacturing a compressor scroll, the scroll 13 can be cleaned by the cleaning fluid at the same time as the water jet peening step.

A device for manufacturing a compressor scroll used in the method for manufacturing a compressor scroll described above will be explained below.

A device 1 for manufacturing a compressor scroll according to the present embodiment, as illustrated in FIG. 6, includes a vessel 2 containing water, a positioning unit 3 that positions the scroll 13 in the vessel 2, and a water jet jetting unit 4 disposed underwater in the vessel 2 that includes a nozzle 4A that jets a water jet J at the scroll 13.

The vessel 2 has a water depth sufficient for the water jet peening step to be performed, in which cavitation bubbles C generated by the water jet J jetted from the nozzle 4A are impinged on the scroll 13 positioned by the positioning unit 3.

The positioning unit 3 is capable of positioning the scroll 13 inside the vessel 2 in a manner so that the water jet peening can be performed. The positioning unit 3, for example, includes a contact portion 3A that comes into contact with the second side of the end plate 13A of the scroll 13, and a chuck portion 3B that engages at a plurality of positions (three for example) around the periphery of the end plate 13A of the scroll 13.

The water jet jetting unit 4 includes the nozzle 4A, a nozzle support portion 4B that supports the nozzle 4A, and a high-pressure water pump 4C that supplies high-pressure water to the nozzle 4A.

The device for manufacturing a compressor scroll jets cavitation bubbles C generated underwater in the vessel 2 by the water jet J of the water jet jetting unit 4 at the first side of the scroll 13 positioned by the positioning unit 3, and as illustrated in FIG. 5, with the center P of the cavitation bubbles C offset from the center O of the spiral shape of the wall portion 13B on the end plate 13A, the outer peripheral portion of the cavitation bubbles C is positioned at the step portion 13Aa and the stepped portion 13Ba.

According to such a device 1 for manufacturing a compressor scroll, the water jet peening step described above in the method for manufacturing a compressor scroll can be performed.

Additionally, in the device 1 for manufacturing a compressor scroll according to the present embodiment, the positioning unit 3 includes the contact portion 3A and the chuck portion 3B which compose a fixing mechanism that fixes the scroll 13 by engaging with the end plate 13A of the scroll 13.

According to this device 1 for manufacturing a compressor scroll, by fixing the scroll 13 via this fixing mechanism, the scroll 13 can be supported in place when the cavitation bubbles C impinge on the scroll 13, allowing the cavitation bubbles C to be appropriately impinged on the target regions (the corner portions A, B) to impart compressive residual stress to the target regions and prevent cracks.

In the device 1 for manufacturing a compressor scroll of the present embodiment, the positioning unit 3, as illustrated in FIGS. 5 and 6, includes a movement mechanism 3C that moves the scroll 13 to intersect with the straight imaginary line L that joins the step portion 13Aa and the stepped portion 13Ba and the positions P1, P2, P3 of the cavitation bubbles C and the scroll 13.

The movement mechanism 3C is preferably a belt conveyor or other similar means for moving the fixing mechanism (the contact portion 3A and the chuck portion 3B) in a parallel manner while supported.

According to the device 1 for manufacturing a compressor scroll, the cavitation bubbles C can be appropriately impinged on the target regions (the corner portions A, B) of the scroll 13 to impart compressive residual stress to the target regions to prevent cracks.

In the device 1 for manufacturing a compressor scroll according to the present embodiment, the movement mechanism 3C includes a plurality of fixing mechanisms to move a plurality of scrolls 13.

According to this device 1 for manufacturing a compressor scroll, the cavitation bubbles C can be appropriately impinged in order on target regions (the corner portions A, B) of a plurality of scrolls 13. As a result, the water jet peening step of the method for manufacturing a compressor scroll described above can be efficiently performed.

In the device 1 for manufacturing a compressor scroll according to the present embodiment, the water jet jetting unit 4 includes a pivot mechanism 4D that pivots the nozzle 4A so that the cavitation bubbles C are pivoted with respect to the scroll 13.

The pivot mechanism 4D is provided on the nozzle support portion 4B and allows the jet direction of the water jet J from the nozzle 4A to be inclined with respect to a vertical line V illustrated in FIG. 6 and rotated about the vertical axis. Such a configuration allows the cavitation bubbles C to directly impinge on the target regions (the corner portions A, B), which are internal angle portion of the end plate 13A and the wall portion 13B. Thus, the cavitation bubbles C can be sufficiently impinged on the target regions of the scroll 13.

REFERENCE SIGNS LIST

1 Device for manufacturing a compressor scroll
2 Vessel
3 Positioning unit
3C Movement mechanism
4 Water jet jetting unit
4A Nozzle
4D Pivot mechanism
12 Fixed scroll (first scroll)
12A End plate
12Aa Step portion
12B Wall portion
12Ba Stepped portion
13 Orbiting scroll (second scroll)
13A End plate
13Aa Step portion
13B Wall portion
13Ba Stepped portion
A, B Corner portion
C Cavitation bubble
J Water jet
L Imaginary line
O Center
P Center
P1, P2, P3 Position

The invention claimed is:

1. A method for manufacturing a compressor scroll, the compressor scroll including a first scroll provided on a spiral-shaped first wall portion disposed on a first side of a first end plate, a second scroll provided on a spiral-shaped second wall portion disposed on a first side of a second end plate, with the second wall portion meshed with the first wall portion of the first scroll, wherein the second scroll is supported for orbiting movement and prevented from rotating, a step portion disposed on the first side of each of the end plates where a height transitions from high on a center portion side of the spiral following the respective wall portion to low on an outer end side, and a stepped portion disposed on each of the wall portions where a height transitions from low on the central portion side of the spiral to high on the outer end side, wherein the stepped portions engage with the corresponding step portions, the method comprising the step of:

water jet peening by jetting cavitation bubbles generated underwater by a water jet at the first side of the end plate of at least one of the scrolls, with a center of the cavitation bubbles being offset from a center of the spiral shape of the wall portion on the end plate and the step portion, and the stepped portion positioned at an outer peripheral portion of the cavitation bubbles, wherein the water jet peening step includes moving the cavitation bubbles and the scroll relative to one another to intersect with a straight imaginary line that joins the step portion and the stepped portion and the positions of the cavitation bubbles and the scroll.

2. The method for manufacturing a compressor scroll according to claim 1, wherein the water jet peening step includes stopping the movement of the cavitation bubbles and the scroll relative to one another for a predetermined period of time at the positions of the cavitation bubbles and the scroll.

3. The method for manufacturing a compressor scroll according to claim 1, wherein the water jet peening step is performed before surface treatment of the scroll.

4. The method for manufacturing a compressor scroll according to claim 1, wherein a cleaning fluid is mixed in with the water where the cavitation bubbles are generated.

5. The method for manufacturing a compressor scroll according to claim 1, the step of the water jet peening further includes a step of relatively moving a plurality of the scrolls.

6. The method for manufacturing a compressor scroll according to claim 1, the step of the water jet peening further includes a step of pivoting the cavitation bubbles with respect to the scroll.

* * * * *